United States Patent [19]

Allen et al.

[11] 4,184,708

[45] Jan. 22, 1980

[54] HANDLING APPARATUS FOR GOODS TRANSPORT CONTAINERS

[75] Inventors: David Allen, Kettering; Robert J. Rowley, Thorney, both of England

[73] Assignee: Modular Distribution Systems Limited, Peterborough, England

[21] Appl. No.: 690,301

[22] Filed: May 26, 1976

[30] Foreign Application Priority Data

| | | | |
|---|---|---|---|
| May 27, 1975 | [GB] | United Kingdom | 23098/75 |
| Nov. 7, 1975 | [GB] | United Kingdom | 46181/75 |
| Feb. 12, 1976 | [GB] | United Kingdom | 5589/76 |

[51] Int. Cl.[2] ..... B66C 1/00

[52] U.S. Cl. ..... 294/67 R

[58] Field of Search ..... 294/81 SF, 67 R, 67 D, 294/67 DA, 67 DB, 67 DC; 214/621, 302, 152, 730, 515, 392

[56] References Cited

U.S. PATENT DOCUMENTS

| | | | |
|---|---|---|---|
| 3,387,729 | 6/1968 | Hindin et al. | 294/67 R |
| 3,541,598 | 11/1970 | Dousset | 214/392 |
| 3,744,652 | 7/1973 | Rieschel | 214/392 |
| 3,773,201 | 11/1973 | Thompson et al. | 294/67 DA |
| 3,840,135 | 10/1974 | Bridge | 214/621 |

*Primary Examiner*—James B. Marbert

*Attorney, Agent, or Firm*—Larson, Taylor and Hinds

[57] ABSTRACT

Handling devices for use in containerized transport systems are adapted for temporary but rigid attachment to the ends of a container. Each device comprises a frame provided with (a) locking devices to engage the standard ISO castings or like fittings of the container, (b) power-operable extending legs with feet, which legs can be extended into ground contact and lift the container to permit loading on to a vehicle or off-loading, and (c) sockets for engagement by the prongs of a fork-lift machine to facilitate handling of the device when being fitted to or removed from the container.

30 Claims, 13 Drawing Figures

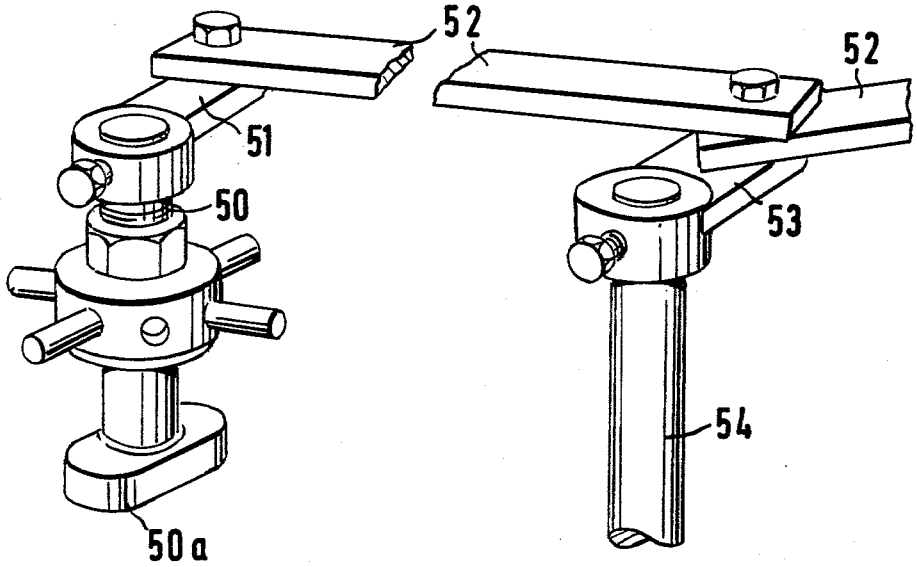
FIG. 7
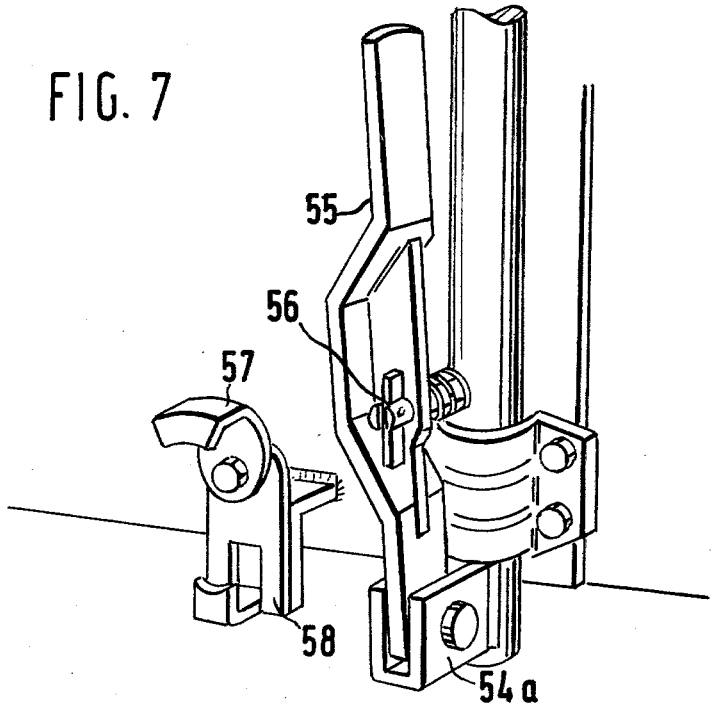

HANDLING APPARATUS FOR GOODS TRANSPORT CONTAINERS

DESCRIPTION

This invention concerns handling devices for containerised transport systems, that is transport systems in which goods to be transported are stowed into containers of standard sizes which containers are transported by road, rail or water, or a combination of these to the desired destination.

A container may be completely closed or of skeletal or flat-bed form and will be provided at each corner with ISO castings or the equivalent for engagement by locking devices on vehicles or by handling equipment.

Such containers when filled may weigh for example 40 tons gross and, therefore, at main depots handling large numbers of containers, it is convenient and economic to provide massive cranes, derricks or mobile machines for picking up, moving and putting down the containers for the purpose of loading them on to or off-loading them from vehicles, or transferring them between vehicles.

However, such massive handling machines are wholly uneconomic for use at large numbers of loading and off-loading sites, for instance factories or stores where only small numbers of containers are handled at any time, and it has therefore been proposed to provide handling devices which can be rigidly, but temporarily, secured to a container and which comprise power-operated extendable legs capable of lifting a filled container sufficiently to allow it to be loaded on to or unloaded from the carrier vehicle and, if desired, to lower the container to the ground so enabling the handling devices to be removed for handling another container.

One proposed form of such device has a single leg so that four such devices are required for handling a container, one for each corner.

A second proposed form of such device comprises a rectangular frame which can be attached by quick release couplings to the container and which carries hydraulic rams the piston rods of which have rollers for engaging the ground when lifting a container.

Both such proposals have disadvantages in operation which it is an object of the invention to avoid.

According to the present invention, a handling device for containerised transport systems comprises a frame of spaced uprights and cross-members joining the uprights, the frame having power-extendable legs and being adapted for rigid attachment to an end of a container by means of first locking devices which project at one face of the frame adjacent the upper ends of its side uprights, the first locking devices being adapted for locking engagement with upper ISO castings or the like fittings of the container, and by means of second locking devices which also project at said face of the frame for locking engagement with bottom ISO castings or the like of the container, and the frame also having sockets for receiving prongs of a fork-lift machine, which sockets open in a direction facing away from the opposite face of the frame.

Such a handling device can be light in weight compared with known handling machines and can be readily handled for attachment to a container by a standard type of fork-lift vehicle.

According to a preferred arrangement, the first locking devices are adjustably mounted on projections extending from said one face of the frame, which projections in use extend over the upper ISO castings or like fittings so that the first locking devices engage the upper castings or fittings by downward movement.

There may also be sockets facing laterally of the frame to allow edgewise handling of the devices, and sockets may be provided either at the top or mid height of the frame or both at the top and mid height. The sockets may if desired be provided by fixed sub-frame structure rigid with and projecting from the face of the frame remote from the locking-device-carrying projections.

According to another feature of this invention, the first locking devices may be coupled together for operation for example so that they can be actuated by an operative standing on the ground.

According to yet another feature of this invention, in order to render a device suitable for use with containers of different heights, means may be provided to vary the vertical spacing of the first and second locking devices. Such means conveniently is in the form of sleeves slidable up and down on the uprights of the frame, the second locking devices being carried by the sleeves, and in this case the legs can be provided with feet at their lower ends and the sleeves may rest freely on the feet whereby the sleeves can be raised and lowered by extending and retracting the legs.

According to a further feature of the invention, the frame may include hollow uprights slidably housing the extendable legs, each hollow upright also accommodating an operating ram for the leg which ram is connected by pivots to an upper part of the upright and to a lower part of the leg, the pivot axis for the upper part extending in a direction at right angles to the pivot axis for the lower part. Such an arrangement has the advantage that the ram is not subjected to lateral loads tending to cause binding of the piston within the ram cylinder. The hollow uprights may form the side members of the frame or may be hollow uprights hinged to the side uprights of the frame to swing outwardly from a stowed position in recesses in the side uprights to an operative position.

Also according to the invention, a lifting and lowering device for attachment to goods containers with ISO castings or the like fitments comprises a post, an extendable leg in telescoping engagement with the post so as to be extendable and retractable relative to the post, an operating ram within the post for effecting extension and retraction of the leg, the ram being connected by pivots to an upper part of the post and to a lower part of the leg so as to relieve the ram of side loads, the post being adapted for attachment to a goods container by means of first locking devices at the upper end of the post for locking engagement with upper ISO castings or the like fittings of the container, and by means of second locking devices for locking engagement with lower ISO castings or the like fittings of the container. As previously stated, the device preferably also includes sockets for receiving prongs of a fork-lift machine for mounting and demounting the device on and from a goods container.

Still further according to the invention, a handling device for containerized transport systems comprises a hollow post, a first locking device for engagement with a container at its top and mounted adjacent the upper end of the post to extend downwardly at a location offset from the axis of the post, an extendable leg slidable vertically within the post, a ram housed within the post and connected between the post and the leg to effect extension and retraction of the leg, a second locking device for engagement with the bottom of a container, means mounting the second locking device for vertical sliding adjustment relative to the post and the leg to vary the vertical spacing of the first and second locking devices, means connected to the first locking device to remotely effect locking of the first locking device to a container, and socket means carried by the handling device for a container, and socket means carried by the handling device for engagement by the fork of a fork-lift machine for mounting and demounting the handling device on and from a container. The mounting means preferably may comprise a sleeve adjustably slidable on the post and having the second locking device mounted thereon or connected thereto.

Other useful features of handling devices will appear from the following description.

The accompanying drawings illustrate by way of example only a number of embodiments of the invention.

Figure 1:
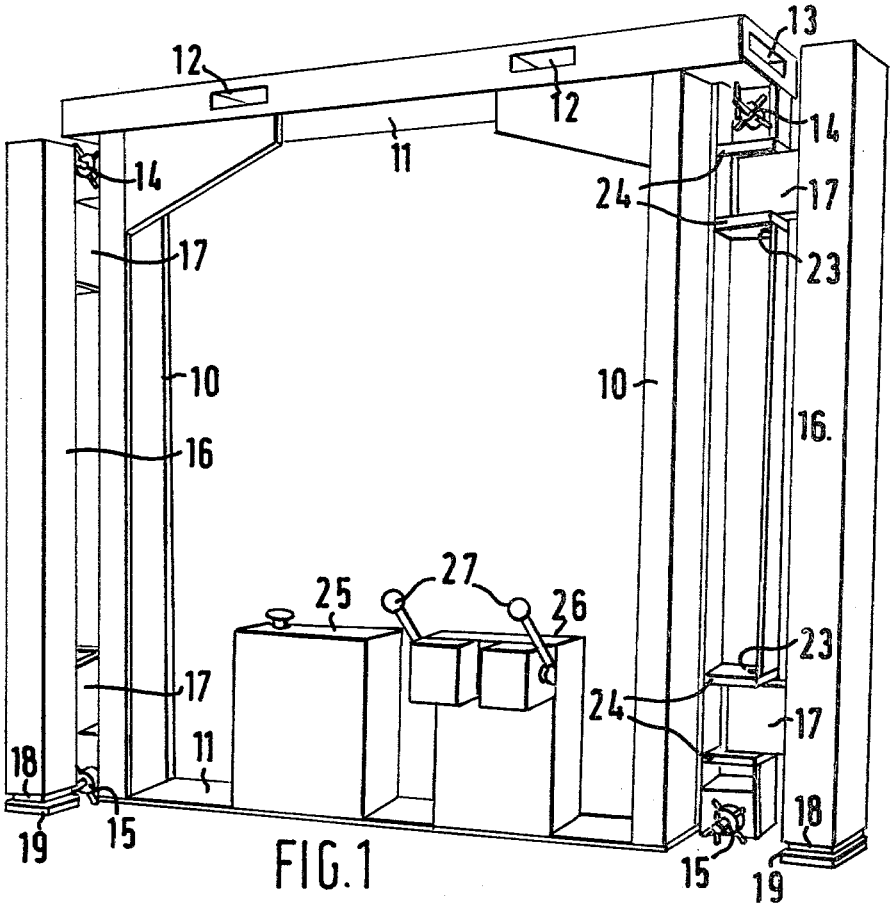
FIG. 1 shows in perspective a first embodiment.
Figure 2:
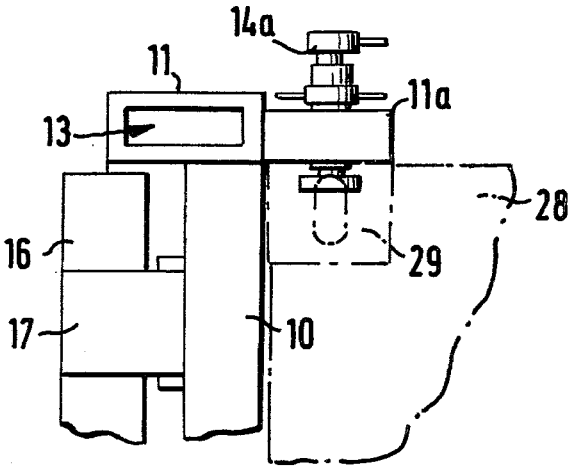
FIG. 2 shows a modification of the embodiment of FIG. 1.
Figure 3:
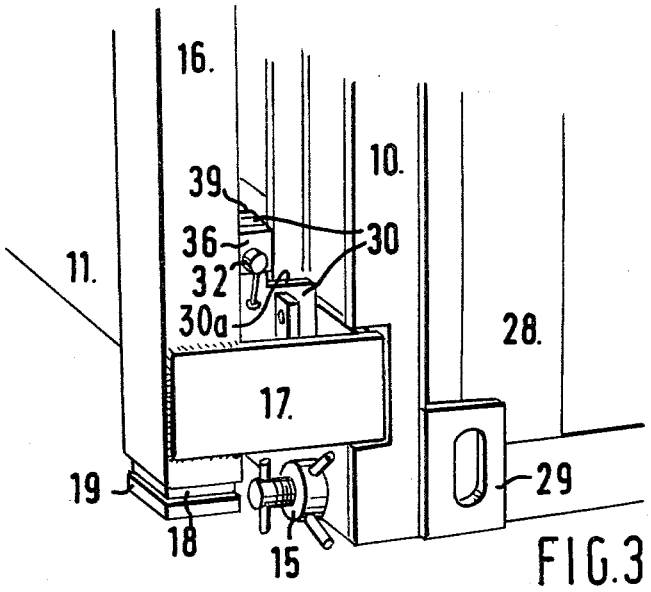
Figure 4:
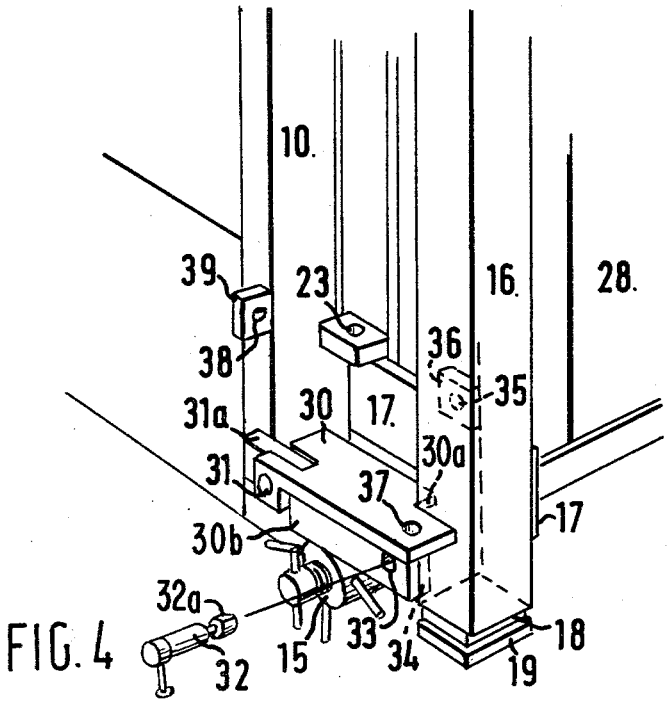
Figure 5:
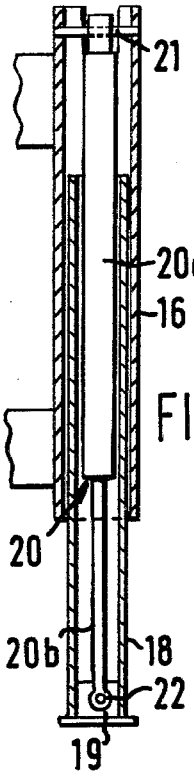
Figure 6:
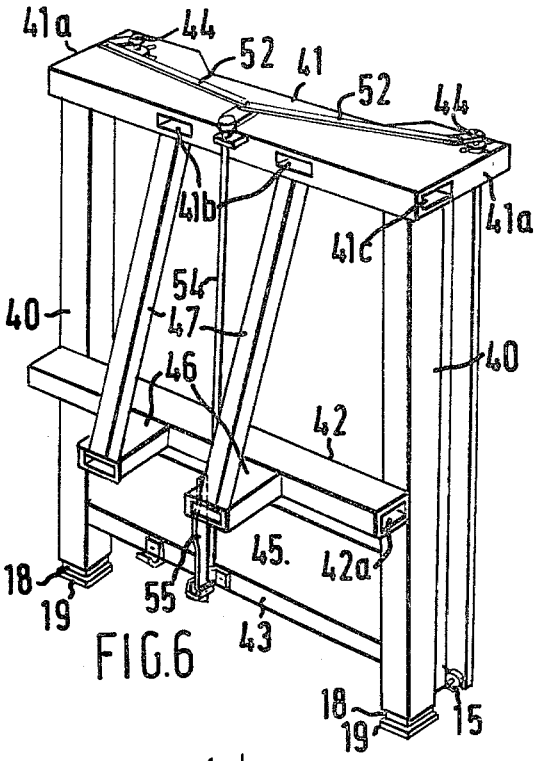
Figure 13:
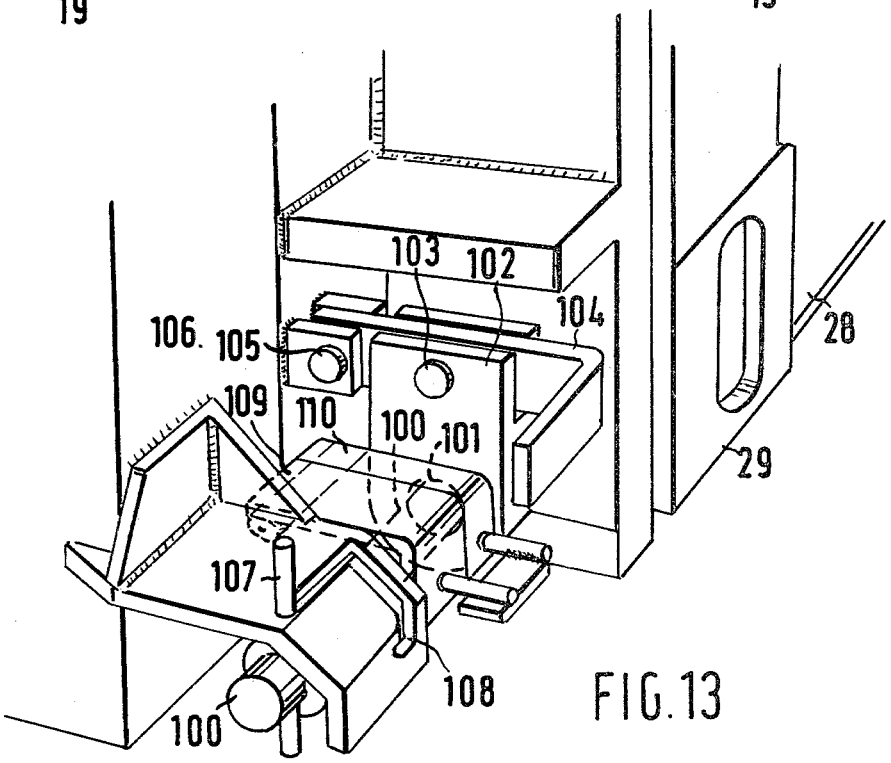
Figure 8:
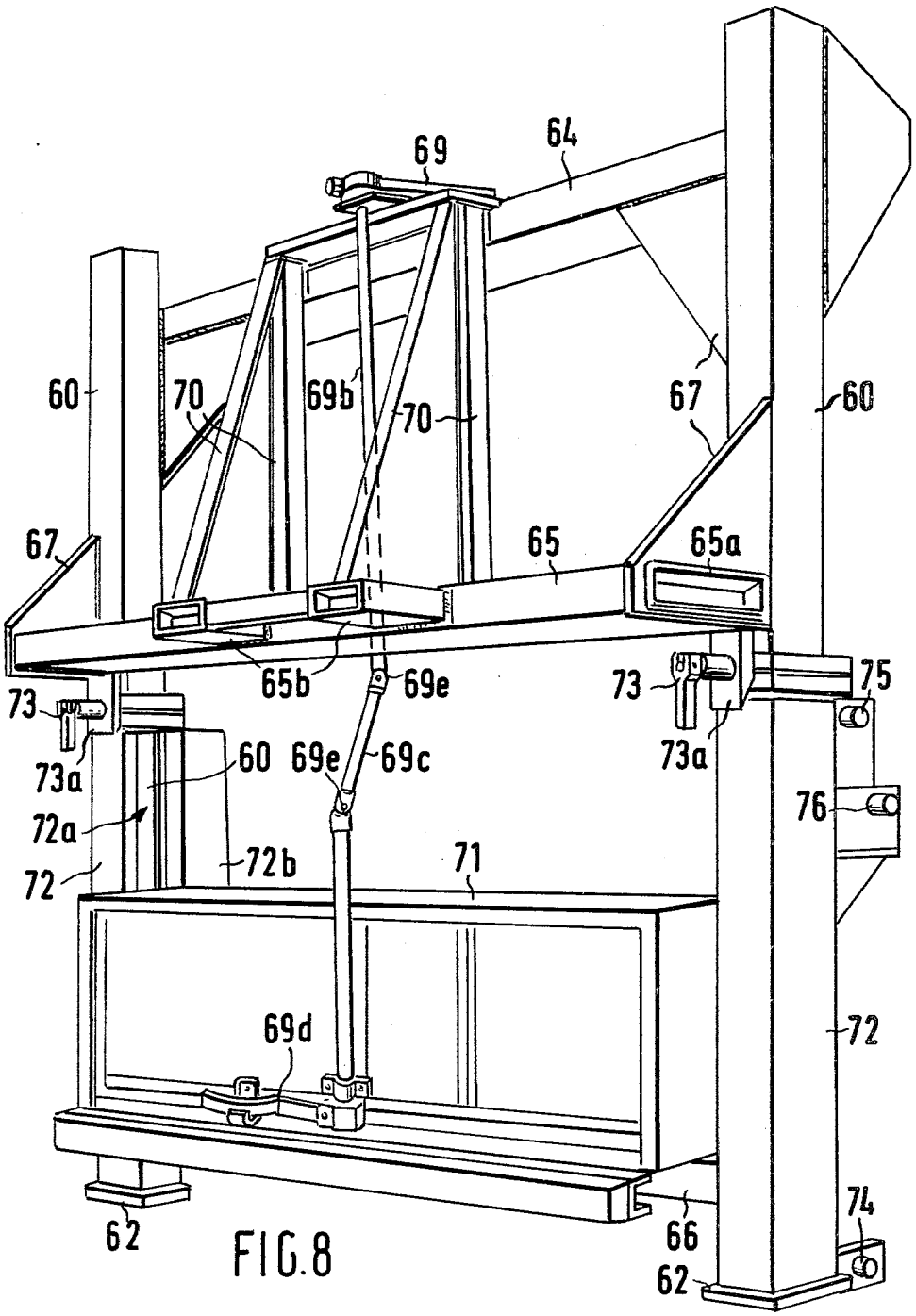
Figure 9:
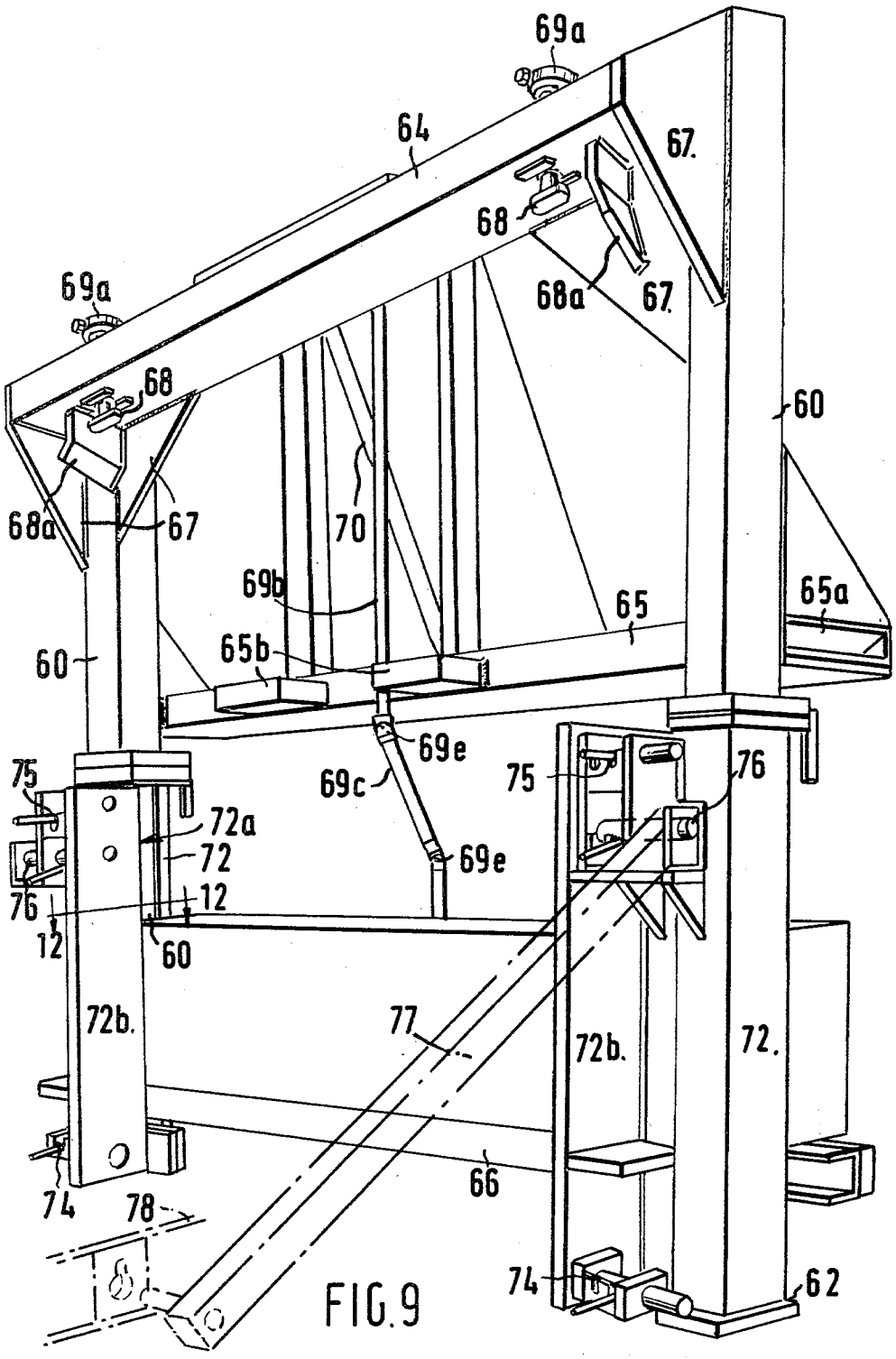
Figure 10:
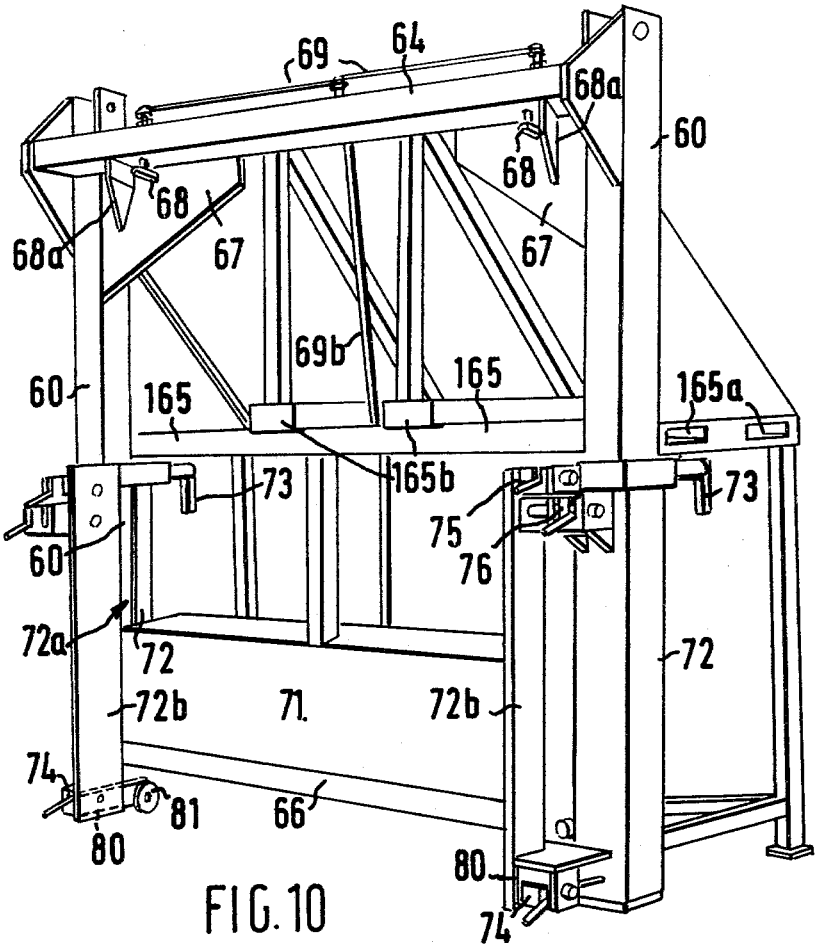
Figure 12:
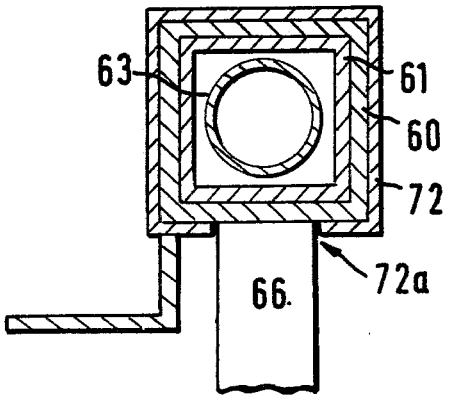
Figure 11:
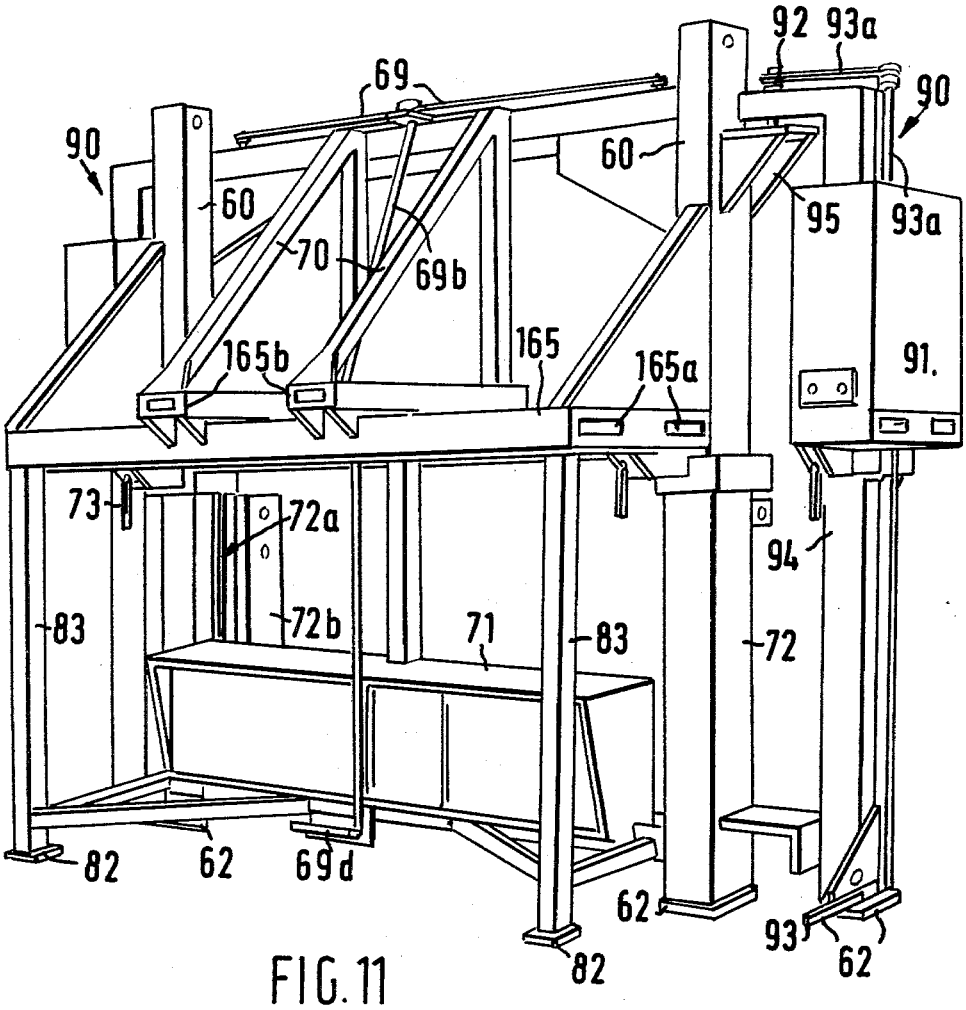

FIGS. 3 and 4 show a construction of locking arrangement for use with the embodiments of FIGS. 1 and 2, FIG. 5 shows in detail one suitable construction of extendable leg and its operating ram, FIG. 6 shows a further embodiment of handling device, FIG. 7 shows a manual control arrangement for top locking devices of the handling devices, FIG. 8 shows another embodiment of handling device of the invention as seen from one side, FIG. 9 shows the embodiment of FIG. 8 from the other side, FIGS. 10 and 11 are views corresponding to FIGS. 8 and 9 of yet another embodiment, FIG. 12 is a local section on the line 12—12 of FIG. 9, and FIG. 13 shows a modification.

The form of handling device shown in FIG. 1 comprises a rigid frame having uprights 10 and cross-members 11 joining the uprights, the upper cross-member having face-on sockets 12 for receiving the lifting prongs of a fork-lift machine and side-on sockets 13 in each end for receiving lifting prongs. Near their upper and lower ends the uprights 10 carry standard twist-lock devices 14, 15 respectively for engaging ISO castings or the like of a standard goods transport container to lock the frame rigidly to the container.

The uprights 10 also carry extendable-leg arrangements. In this case, each leg arrangement comprises a for example square-section housing 16 to which are attached hinge plates 17, a similar section leg 18 (FIGS. 1 and 5) slidable within the housing, the leg having a ground-engaging foot 19, and a ram 20 accommodated within the housing 16 and leg 18. The upper end of the ram, for example of the ram cylinder 20*a* in the case of an hydraulic ram, is connected by a pivot pin 21 to the upper end of the housing 16, and the lower end of the ram, for example the lower end of the ram piston rod 20*b* in the case of an hydraulic ram, is connected to the foot 19 and lower end of the leg 18. The axis of pin 21 extends in a direction at right angles to the axis of pin 22 so as to relieve the ram of side loads.

The hinge plates 17 are engaged by pivot pins 23 mounted in brackets 24 secured to the uprights 10 so that the leg arrangements can be swung between a stowed position as shown at the left of FIG. 1 to an outboard position as shown at the right of FIG. 1. In the cutboard position, the legs can be extended and retracted and, when the legs have hydraulic rams, the lower cross-member 11 may have mounted on it an hydraulic power pack 25 and electrical control gear 26 including a control lever 27 for each leg.

FIG. 2 shows a modification of FIG. 1 in that instead of the upper twist-locks 14 being as shown in FIG. 1, the upper cross member 11 of the frame is provided with extensions 11*a* which, when the frame is attached to a container 28, overhang the top of the container so that the top twist-locks 14*a* can enter the ISO castings 29 through their upwardly-facing openings.

When the frames have leg arrangements which swing between stowed and outboard positions, it is desirable to provide suitable locking means to hold them in these positions.

One form of such locking means is shown in FIGS. 3 and 4. The locking means comprises a latch 30 pivoted by a pin 31 to a lug 31*a* secured on the upright 10 to swing between an upright position (FIG. 3) to a horizontal position (FIG. 4) in which a notch 30*a* in the latch lies against the housing 16 and in which a peg 32 can pass through holes 33 in a flange 30*b* on the latch and a lug 34 on the housing 16 to lock them together. When the latch 30 is upright and the leg arrangement is stowed (FIG. 3), the peg 32 passes through a hole 35 in a lug 36 on the housing, a hole 37 in the latch 30, and a hole 38 in a lug 39 on the upright 10 to lock these together. The peg 32 is circular in section but has a head 32*a* with a flat. The holes in lugs 34 and 39 are correspondingly shaped so that the head will only pass these holes in one angular setting and so that, when turned from this setting, the peg 32 cannot be removed.

In the embodiment of handling device of FIG. 6, the frame comprises hollow uprights 40 which are like the housings 16 of FIG. 5 and are interconnected by cross-members 41, 42, 43. The extendable legs 18 and their rams are accommodated in the uprights in the manner shown in FIG. 5.

The top cross-member 41 has extensions 41*a* beyond one face of the frame to overlie the top of a container, these extensions carrying the top twist-lock devices 44 for engaging by downward movement into the upwardly-facing holes of top ISO castings. The cross-member 41 also has face-on and side-on fork-lift pockets 41*b*, 41*c*.

The lower cross-member 43 supports casings 45 housing a power pack and control means (neither of which is shown) for operating the rams for extending and retracting the legs 18.

The mid-height cross-member 42 has at its ends side-on fork-lift pockets 42*a* and supports face-on pockets 46 which project in a direction oppositely to the extensions 41*a* and are braced by sub-frame members 47 extending upwards to the top cross-member 41.

In order to avoid the necessity for the operator to climb to the top of a container to engage the top twist locks, such as 44, means are conveniently provided for their actuation whilst the operator is standing on the ground.

FIG. 7 shows a simple manually-operated construction for this purpose. The rotatable spindle 50 of each locking member 50*a* has secured to it a radius arm 51 which is connected by a link 52 to a radius arm 53 on centrally-arranged downwardly-extending shafting 54, the arrangement being that rotation of the shafting 54 through 90° turns the spindles 50 correspondingly. An operating handle 55 is pivoted at 54*a* to the bottom of the shafting 54 and can be locked either in a position lying along the shafting 54 (as shown) by a spring-loaded, toggle-headed retainer 56 which passes through a hole in the handle, or in a horizontal position after turning the shafting through 90° by a pivoted catch 57 trapping the handle in a U-shaped bracket 58.

Although containers used in modern transport systems conform substantially to a single standard width, the height of containers may vary, full height containers varying by as much as 1 foot 6 inches and some containers even being of so-called "half-height" that is about 4 feet high.

It is desirable in some circumstances therefore that handling devices of the invention should be capable of accommodating such height variations, and some embodiments of handling device for this purpose will now be described.

Referring to FIGS. 8, 9 and 12, the handling device shown comprises hollow frame uprights 60, of rectangular section, e.g. square section, providing housings for extendable legs 61 with feet 62 and rams, e.g. hydraulic rams 63, for operating the legs. The frame also comprises horizontal cross-members 64, 65, 66 joining the hollow uprights 60, to provide a strong rigid frame structure. Gusset plates 67 are provided to give added strength.

The cross-member 64 is offset from the uprights to overhang a container top when in use and the member 64 has mounted on it top twist-lock devices 68 and top guide plates 68*a* to assist accurate positioning of these twist-lock devices relatively to a container. The twist-lock devices are operable from ground level by a manual linkage 69*a* to 69*d* such as is described above with reference to FIG. 7 but including a shafting section 69*c* joined to adjacent sections by universal joints 69*e*.

The mid-height cross-member 65 has side-on fork-lift pockets 65*a* and has built into it face-on fork-lift pockets 65*b*, these being braced by an integral sub-frame structure 70 joining the cross-members 64, 65.

The bottom cross-member 66 carries a power pack and control console 71 for effecting operation of the legs 61.

In order to accommodate container height variations each of the uprights has a sleeve 72 slidably mounted on it for up and down movement, the sleeves having in them slots 72*a* for passage of the bottom cross-member 66. The sleeves 72 can be locked to the frame in their uppermost positions by retractable locking pegs 73 which are mounted in lugs 73*a* depending from the cross-member 65 and which, when retracted, leave the sleeves resting on the feet 62 of the extendable legs.

The sleeves 72 have welded to them heavy gauge flange plates 72*b* which carry the lower locking devices comprising the bottom locking devices 74 for engaging the bottom corner ISO castings of a container, mid-locking devices 75 for engaging the top ISO castings of half-height containers and further locking devices 76 which can engage ISO castings of half-height containers or struts 77 for bracing a handling device when used with a pallet type or half-height container 78.

When the handling device is to be attached to a container it is raised by a fork-lift machine and presented, either face on using pockets 65*b* or side-on by using pockets 65*a*, so that the cross-member 64 overhangs the container top, and is then lowered until the top locking devices 68 engage the top ISO castings. The devices are then locked using the manual operating linkage 69*a*–69*e*.

The locking pegs 73 are now withdrawn and the legs 61 lowered until the bottom locking devices 74 are aligned with the bottom ISO castings of the container. These devices are then engaged. If required the devices 75, 76 are also brought into use.

After the fork-lift machine has withdrawn the legs 61 may be used to lift the container.

FIGS. 10 and 11 show a similar form of handling device. In this construction, however, the mid cross-member 165 has pairs of side-on fork-lift pockets 165*a* in its ends and a pair of face-on fork-lift pockets 165*b*. Also the flange plates 72*b* carry at the bottom ends brackets 80 for rollers 81 to ease up or down movement of the sleeves 72 when the frame is being fitted on the end of a container.

The device is also provided with offset ground-engaging feet 82 on integral sub-structural members 83 so that the device can be left free-standing when the device is detached from a container and the legs are fully retracted.

The device is also shown in FIG. 11 as provided with single-leg satellites 90. Each satellite has a built-on power-pack and control unit 91 for its extendable leg, a top twist-lock 92 operable manually by handle 93 through linkage 93*a*, and a bottom twist-lock and mid-height twist-locks on a sliding sleeve 94 (like the sleeves 72). When not in use, the satellites 90 may be hooked on to brackets 95 on the uprights 60 of the main device. The satellites are used when for lack of space a main device cannot conveniently be attached to one end of a container.

It will be appreciated that in use the bottom ISO castings 29 of a container 28 may become damaged or deformed, and it may therefore be useful if the shaped head of the twist-lock can be moved transversely of its stem to assist passage of the head into the casting pocket.

Such movement is permitted by an arrangement as shown in FIG. 13 in which the stem of the twist-lock 100 passes through holes 101 of a stirrup 102 pivoted at 103 to an arm 104 pivoted at 105 on the frame 106 of the handling device. By rocking the arm and stirrup, slight misalignment of the head of the twist-lock and the opening in the ISO casting 29 can be taken care of.

The twist-lock is moved from its unlocked to its locked positions by moving cross-pin 107 along slot 108 from the position shown to the other end of the slot during which movement the twist-lock is turned through 90°.

A pair of pivoted latches 109, 110 are provided for locking the twist-lock. When both latches are in the position shown, the twist-lock is held inoperative, when both latches are raised the pin 107 may be fed around the slot 108, and when only the latch 110 is down the pin 107 will be held at the end of the lower limb of the slot so holding the twist-lock in its engaged and locked position.

Whilst in the foregoing description extendable legs and housings of square section are shown, it will be appreciated that other sections may be adopted, e.g. rectangular and circular are convenient.

Among the important novel features of the above-described frames for handling containers with ISO castings or the like, the containers being closed or skeletal or flat bed, are the following:

The provision of a frame securable to the container at its ends provided with fork-lift prong pockets facing in two directions at right angles, to allow end-wise or side-ways presentation, and provided with extendable legs guided in housings and moved by separate motor means.

The motor means are rams in the leg housings and connected to the housings and legs in a manner relieving the rams of lateral loads.

The rams are operable from a power source built into the frame or separate from it.

The top locking devices of the frame are remotely operable either mechanically, hydraulically, electrically or in any combination of these.

Means is provided to accommodate variations in container height.

We claim:

1. A handling device for containerised transport systems, which device has a frame for attachment to the end wall of a container, said frame comprising spaced uprights and cross-members joining the uprights, the frame having extendable legs slidable vertically relative to the uprights and power means to effect the vertical sliding of the legs, and the frame being adapted for rigid attachment to an end of a container by means of first locking devices which project at one face of the frame adjacent the upper ends of its side uprights, the first locking devices being adapted for locking engagement with upper ISO castings or the like fittings of the container, and by means of second locking devices which also project at said face of the frame for locking engagement with bottom ISO castings or the like of the container, and the frame also having sockets for receiving prongs of a fork-lift machine, which sockets open in a direction facing away from the opposite face of the frame.

2. A handling device according to claim 1, wherein said first locking devices are adjustably mounted on projections extending from said one face of the frame, which projections in use extend over the upper ISO castings or like fittings so that the first locking devices engage the upper castings or fittings by downward movement.

3. A handling device according to claim 1, wherein the frame also has further fork-lift prong-receiving sockets facing laterally of the frame.

4. A handling device according to claim 3, having the sockets adjacent the upper end of the frame.

5. A handling device according to claim 3, having the sockets at about mid-height of the frame.

6. A handling device according to claim 5, wherein the sockets are provided by fixed sub-frame structure rigid with and projecting from the face of the frame remote from the locking-device-carrying projections.

7. A handling device according to claim 1, wherein mechanical means are provided coupling the first locking devices together for simultaneous operation, and operating means extend downwardly from the mechanical means to permit remote actuation of the first locking devices.

8. A handling device according to claim 7, wherein the first locking devices are rotatably mounted and are coupled together for operation by a linkage actuated by shafting extending upwards from adjacent the bottom of the frame, and means to rotate the shafting.

9. A handling device according to claim 8, wherein the shafting terminates at its lower end in a handle for rotating the shafting, the handle being lockable in positions corresponding to the locked and unlocked settings of the first locking devices.

10. A handling device according to claim 1, wherein means are provided to vary the vertical spacing of the first and second locking devices.

11. A handling device according to claim 10, wherein said means comprises sleeves slidable up and down on the uprights of the frame, the second locking devices being carried by the sleeves.

12. A handling device according to claim 11, wherein the extendable legs have feet at their lower ends, and the sleeves rest freely on the feet whereby the sleeves can be raised and lowered by extending and retracting the legs.

13. A handling device according to claim 11, wherein the sleeves also carry third locking devices for attachment of the handling device to half-height containers, the third locking devices being at a height between the first and second locking devices.

14. A handling device according to claim 1, having the second locking devices carried by means allowing limited freedom of movement of the devices in two directions at right angles and normal to the axes of the locking devices.

15. A handling device according to claim 14, wherein each second locking device is carried by a stirrup pivoted to an arm which is itself pivoted on the frame.

16. A handling device according to claim 1, wherein the frame includes hollow uprights slidably housing the extendable legs, each hollow upright also accommodating an operating ram for the leg which ram is connected by pivots to an upper part of the upright and to a lower part of the leg, the pivot axis for the upper part extending in a direction at right angles to the pivot axis for the lower part.

17. A handling device according to claim 16, the hollow uprights and legs being of rectangular, e.g. square, cross section.

18. A handling device according to claim 16, the hollow uprights being the side uprights of the frame.

19. A handling device according to claim 16, the hollow uprights being hinged to the side uprights of the frame to swing outwardly from a stowed position in recesses in the side uprights to an operative position.

20. A handling device according to claim 1, wherein the frame also includes fixed steady members which are offset from the legs and which come into ground contact when the extendable legs are fully retracted.

21. A handling device according to claim 11, comprising rollers on the sleeves adjacent their lower ends to make contact with the container when attaching the device to it.

22. A handling device according to claim 1, wherein the frame includes hollow uprights slidably housing the extendable legs, each hollow upright also accommodating an operating ram for the leg, which ram is connected by pivots to an upper part of the upright and to a lower part of the leg so as to relieve the ram of side loads.

23. A handling device for containerized transport systems, which device comprises a frame of spaced uprights and cross-members joining the uprights, the frame having power-extendable legs and being adapted for rigid attachment to an end of a container by means of first locking devices which project at one face of the frame adjacent the upper ends of its side uprights, the first locking devices being adapted for locking engagement with upper ISO castings or the like fittings of the container, and by means of second locking devices which also project at said face of the frame for locking engagement with bottom ISO castings or the like of the container, said uprights being hollow and housing the extendable legs, each hollow upright also accommodating an operating ram for the leg housed within the said upright, which ram is connected by pivots to an upper part of the upright and to a lower part of the leg so as to relieve the ram of side loads.

24. A handling device as claimed in claim 23 wherein the pivot axis for the upper part extends in a direction at right angles to the pivot axis for the lower part.

25. A lifting and lowering device for attachment to goods containers with ISO castings or the like fitments, which device comprises a post, an extendable leg in telescoping engagement with the post so as to be extendable and retractable relative to the post, an operating ram within the post for effecting extension and retraction of the leg, said ram being connected by pivots to an upper part of said post and to a lower part of the leg so as to relieve the ram of side loads, said post being adapted for attachment to a goods container by means of first locking devices at the upper end of the post for locking engagement with upper ISO castings or the like fittings of the container, and by means of second locking devices for locking engagement with lower ISO castings or the like fittings of the container.

26. A device as claimed in claim 25 wherein the pivot axis for the upper part extends in a direction at right angles to the pivot axis of the lower part.

27. A device as claimed in claim 25 further comprising sockets carried by said device for receiving prongs of a fork-lift machine for mounting and demounting said device on and from a goods container.

28. A device as claimed in claim 25 wherein said post is of non-circular section, and said extendable leg is housed within the post and is of corresponding section.

29. A handling device for containerized transport systems, comprising a hollow post, a first locking device for engagement with a container at its top and mounted adjacent the upper end of the post to extend downwardly at a location offset from the axis of the post, an extendable leg slidable vertically within the post, a ram housed within the post and connected between the post and the leg to effect extension and retraction of the leg, a second locking device for engagement with the bottom of a container, means mounting the second locking device for vertical sliding adjustment relative to the post and the leg to vary the vertical spacing of the first and second locking devices, means connected to the first locking device to remotely effect locking of the first locking device to a container, and socket means carried by the handling device for engagement by the fork of a fork-lift machine for mounting and demounting the handling device on and from a container.

30. A device as claimed in claim 29 wherein said mounting means comprises a sleeve adjustably slidable on the post and having said second locking device mounted thereon.

* * * * *